US009031765B2

(12) United States Patent
Shin et al.

(10) Patent No.: US 9,031,765 B2
(45) Date of Patent: May 12, 2015

(54) METHOD TO COMPLETE A LEARNING CYCLE OF A RECURSIVE LEAST SQUARES APPROXIMATION

(75) Inventors: Kwang-Keun Shin, Rochester Hills, MI (US); Jun-Mo Kang, Ann Arbor, MI (US); Hanho Yun, Oakland Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 617 days.

(21) Appl. No.: 13/362,051

(22) Filed: Jan. 31, 2012

(65) Prior Publication Data

US 2013/0197781 A1 Aug. 1, 2013

(51) Int. Cl.

| | |
|---|---|
| ***F02D 41/24*** | (2006.01) |
| *F02D 41/30* | (2006.01) |
| *F02D 41/20* | (2006.01) |

(52) U.S. Cl.

CPC ..... *F02D 41/2438* (2013.01); *F02D 41/24* (2013.01); *F02D 41/2467* (2013.01); *F02D 41/3035* (2013.01); *F02D 2041/2058* (2013.01); *F02D 41/2445* (2013.01); *F02D 2200/0616* (2013.01)

(58) Field of Classification Search

CPC ..... F02D 41/1402; F02D 41/1406; F02D 2041/1429; F02D 2041/1143

USPC ..... 701/104, 106; 123/674

See application file for complete search history.

(56) References Cited

U.S. PATENT DOCUMENTS

| | | | | |
|---|---|---|---|---|
| 6,644,291 | B2 * | 11/2003 | Stroh et al. | 123/674 |
| 6,994,072 | B2 | 2/2006 | Kuo et al. | |
| 7,016,779 | B2 * | 3/2006 | Bowyer | 701/108 |
| 7,128,047 | B2 | 10/2006 | Kuo et al. | |
| 2003/0172914 | A1 * | 9/2003 | Stroh et al. | 123/674 |
| 2005/0091294 | A1 * | 4/2005 | Tuken et al. | 708/200 |
| 2009/0205612 | A1 | 8/2009 | Wermuth et al. | |
| 2010/0224167 | A1 * | 9/2010 | Leone et al. | 123/299 |
| 2010/0294235 | A1 * | 11/2010 | Lewis et al. | 123/299 |

OTHER PUBLICATIONS

U.S. Appl. No. 12/791,385, Ramappan et al., Not Publ'd.

* cited by examiner

*Primary Examiner* — Erick Solis

(57) ABSTRACT

A method to control a non-linear system includes operating a learning cycle to approximate characteristics of the system and, once the learning cycle is complete, operating the system based upon the characteristics. The learning cycle includes monitoring operation of the system, approximating the characteristics of the system with a recursive least squares approximation based upon the monitored operation, comparing variance of the operation to a threshold variance, and completing the learning cycle based upon the variance exceeding the threshold variance.

11 Claims, 3 Drawing Sheets

METHOD TO COMPLETE A LEARNING CYCLE OF A RECURSIVE LEAST SQUARES APPROXIMATION

TECHNICAL FIELD

This disclosure is related to approximating characteristics of a system exhibiting non-linear behavior.

BACKGROUND

The statements in this section merely provide background information related to the present disclosure. Accordingly, such statements are not intended to constitute an admission of prior art.

Modeling or approximating characteristics of a system can be useful in a method to control the system. A system that operates unpredictably in different operating ranges is considered non-linear, meaning that observations made regarding the operation of the system on one operating range may not be useful to predict operation of the system in another operating range.

Fuel injectors are utilized to inject fuel into a combustion chamber of an engine. Fuel injectors provide pressurized fuel from a fuel rail to the combustion chamber. A fuel injector is activated at a timing or timings of a combustion cycle and remain open based upon a controlled fuel pulse width (FPW) to provide intended or desired fuel injections to the combustion chamber.

Internal combustion engines utilize valve timing or phasing strategies to effect changes to engine operation and performance. Valve opening and closing timings influence the thermodynamic cycle and the combustion process, including fuel efficiency, emissions, and engine torque level.

A number of advanced combustion strategies are known. Homogeneous-charge compression ignition (HCCI) operates at lower engine loads and speeds. HCCI strategies are designed to improve the efficiency and emissions of the internal combustion engine, through a combination of reduced pumping work, an improved combustion process, and improved thermodynamics. Methods are known to extend ranges at which HCCI can be operated, including utilizing negative valve overlap, reforming fuel during negative valve overlap, and spark-assisted HCCI operation.

SUMMARY

A method to control a non-linear system includes operating a learning cycle to approximate characteristics of the system and, once the learning cycle is complete, operating the system based upon the characteristics. The learning cycle includes monitoring operation of the system, approximating the characteristics of the system with a recursive least squares approximation based upon the monitored operation, comparing variance of the operation to a threshold variance, and completing the learning cycle based upon the variance exceeding the threshold variance.

BRIEF DESCRIPTION OF THE DRAWINGS

One or more embodiments will now be described, by way of example, with reference to the accompanying drawings, in which.

DETAILED DESCRIPTION

Figure 1:
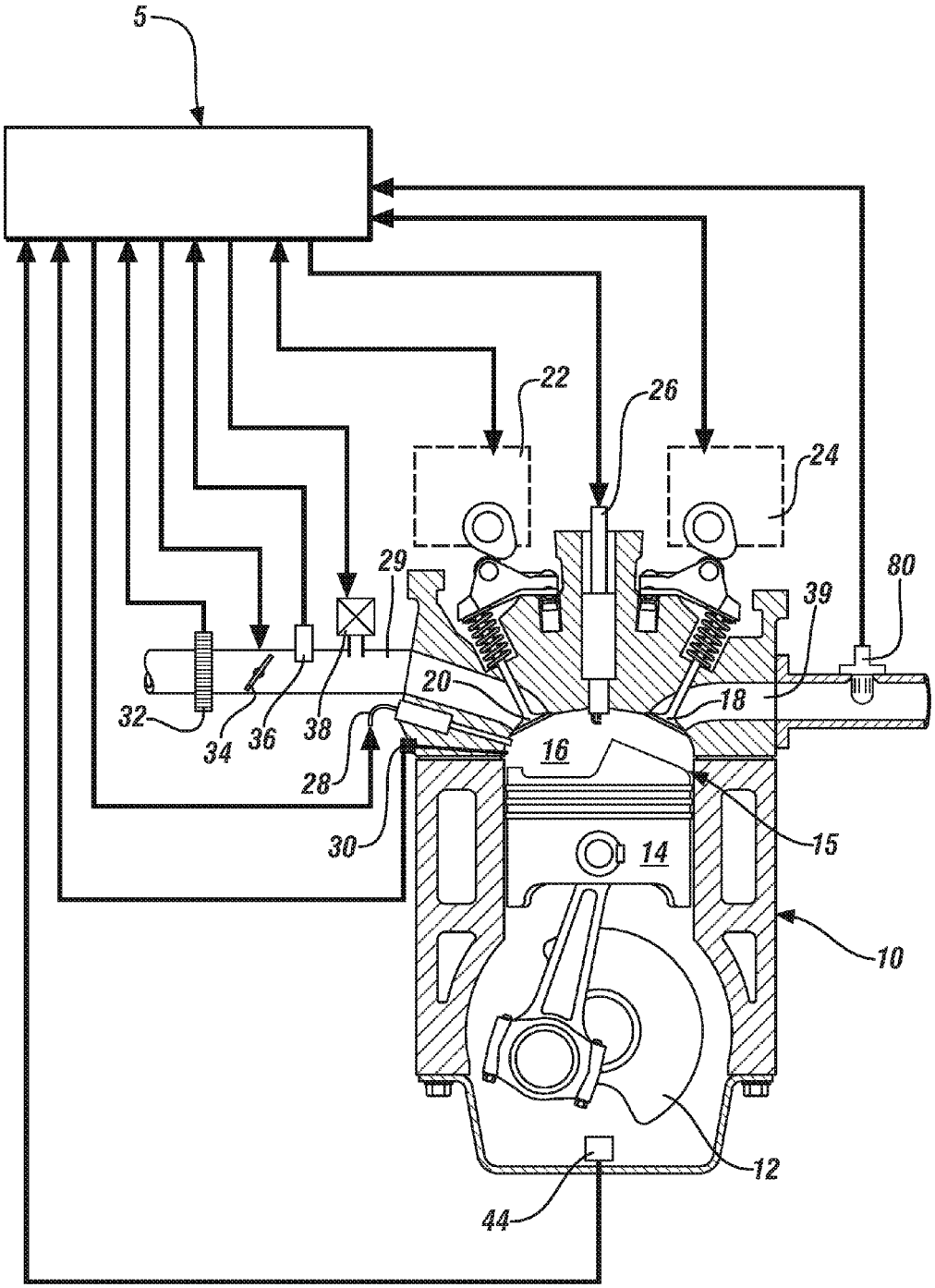
FIG. 1 schematically shows an internal combustion engine and accompanying control module, in accordance with the present disclosure.

Referring now to the drawings, wherein the showings are for the purpose of illustrating certain exemplary embodiments only and not for the purpose of limiting the same, a number of analytical or statistical methods are known to curve fit or approximate behavior of a system exhibiting non-linear behavior based upon a collection of data points. One method to learn characteristics of a system exhibiting non-linear behavior includes utilizing recursive least squares (RLS) approximation or determination. Iterations of data collection and analysis can be continued through a learning cycle until characteristics of the system being approximated are sufficiently mapped that the linear approximation curve can be used to control the system with high confidence.

An engine utilizing direct fuel injection utilizes a fuel injector to control precise fuel injection timings and amounts. Fuel injectors exhibit non-linear behavior, with different fuel injection characteristics at different fuel flow rates. An RLS approximation can be used to approximate characteristics of behavior of a fuel injector. An RLS approximation provides the parameters of a linear approximation curve that is fitted to the injector characteristics based on fuel pulse width and estimated resulting mass of fuel injected into the cylinder. According to one method, the data for the RLS approximation can be collected during real time engine operation through various engine operating points. Iterative data collection and analysis can be used to populate data points useful to fit the linear approximation curve to the fuel injector characteristics.

During the learning cycle, the fuel injector is controlled by a default or obsolete control method. It can be critical to determine when learning is completed such that the new control parameters determined in the learning cycle are delivered to the fuel controller as quickly as possible to avoid potential misfires/partial burns due to imprecise fuel injection mass. If the system ends learning too late, the period of inefficient operation by the default or obsolete control method is extended. If the system ends learning too soon, an inaccurate approximation curve can be used to control the fuel injections, leading to too much or too little fuel being injected until a new learning cycle occurs.

Accurate approximation of characteristics of a system through an RLS approximation requires that the system operate through a sufficiently wide range of operation to perform the approximation. A method to determine when a learning cycle of an RLS approximation is completed includes evaluating whether operation of the system being approximated has varied sufficiently for an accurate RLS approximation. Because the system being approximated operates differently in different operating ranges, behavior in the different operating ranges must be adequately observed in order to complete the approximation. With any application of RLS approximation, the disclosed method to determine when the learning cycle is complete can improve the estimation performance by minimizing learning time.

Methods disclosed herein can utilize an RLS approximation including a learning cycle to provide rapid and accurate control of a fuel injector. It will be appreciated that the methods disclosed to provide adaptive control of a fuel injector can be used with other systems requiring adaptive control. An RLS approximation including a learning cycle can be used in a number of embodiments, for example, include a system to approximate volumetric efficiency of an engine equipped with variable cam timing, a system to control ship steering where auto-pilot algorithm needs to learn dynamic behavior of a ship varying with speed, trim, loading, etc., and a control system for an industrial robot arm where RLS can be used to estimate the inertia of the arm which is critical for precise motion control.

FIG. 1 schematically shows an internal combustion engine 10 and accompanying control module 5. The engine 10 is selectively operative in a controlled auto-ignition combustion mode, a homogeneous spark-ignition combustion mode, and a stratified-charge spark-ignition combustion mode. The exemplary engine 10 comprises a multi-cylinder direct-injection four-stroke internal combustion engine having reciprocating pistons 14 slidably movable in cylinders 15 which define variable volume combustion chambers 16. Each piston 14 is connected to a rotating crankshaft 12 by which their linear reciprocating motion is translated to rotational motion. An air intake system provides intake air to an intake manifold 29 which directs and distributes air into an intake runner to each combustion chamber 16. The air intake system comprises airflow ductwork and devices for monitoring and controlling the air flow. The air intake devices preferably include a mass airflow sensor 32 for monitoring mass airflow and intake air temperature. A throttle valve 34 preferably comprises an electronically controlled device which controls air flow to the engine 10 in response to a control signal (ETC) from the control module 5. A pressure sensor 36 in the manifold is adapted to monitor manifold absolute pressure and barometric pressure. An external flow passage recirculates exhaust gases from engine exhaust to the intake manifold, having a flow control valve, referred to as an exhaust gas recirculation (EGR) valve 38. The control module 5 is operative to control mass flow of exhaust gas to the intake manifold 29 by controlling opening of the EGR valve 38.

Air flow from the intake manifold 29 into each of the combustion chambers 16 is controlled by one or more intake valves 20. Flow of combusted gases from each of the combustion chambers 16 to an exhaust manifold 39 is controlled by one or more exhaust valves 18. Openings and closings of the intake and exhaust valves 20 and 18 are preferably controlled with a dual camshaft, the rotations of which are linked and indexed with rotation of the crankshaft 12. The engine 10 is equipped with devices for controlling valve lift of the intake valves and the exhaust valves, referred to as variable lift control (VLC) devices. The variable lift control devices in this embodiment are operative to control valve lift, or opening, to one of two distinct steps, e.g., a low-lift valve opening (about 4-6 mm) for low speed, low load engine operation, and a high-lift valve opening (about 8-10 mm) for high speed, high load engine operation. The engine is further equipped with devices for controlling phasing (i.e., relative timing) of opening and closing of the intake and exhaust valves 20 and 18, referred to as variable cam phasing (VCP), to control phasing beyond that which is effected by the two-step VLC lift. There is a VCP/VLC system 22 for the intake valves 20 and a VCP/VLC system 24 for the engine exhaust valves 18. The VCP/VLC systems 22 and 24 are controlled by the control module 5, and provide signal feedback to the control module 5, for example through camshaft rotation position sensors for the intake camshaft and the exhaust camshaft. When the engine 10 is operating in the HCCI combustion mode with an exhaust recompression valve strategy, the VCP/VLC systems 22 and 24 are preferably controlled to the low lift valve openings. When the engine is operating in the homogeneous spark-ignition combustion mode, the VCP/VLC systems 22 and 24 are preferably controlled to the high lift valve openings. When operating in the HCCI combustion mode, low lift valve openings and negative valve overlap may be commanded to generate reformates in the combustion chamber 16. There may be a time lag between a command to change cam phasing and/or valve lift of one of the VCP/VLC systems 22 and 24 and execution of the transition due to physical and mechanical properties of the systems.

The intake and exhaust VCP/VLC systems 22 and 24 have limited ranges of authority over which opening and closing of the intake and exhaust valves 18 and 20 may be controlled. VCP systems may have a range of phasing authority of about 60°-90° of cam shaft rotation, thus permitting the control module 5 to advance or retard valve opening and closing. The range of phasing authority is defined and limited by the hardware of the VCP and the control system which actuates the VCP. The intake and exhaust VCP/VLC systems 22 and 24 may be actuated using one of electro-hydraulic, hydraulic, and electric control force, controlled by the control module 5. Valve overlap of the intake and exhaust valves 20 and 18 refers to a period defining closing of the exhaust valve 18 relative to an opening of the intake valve 20 for a cylinder. The valve overlap may be measured in crank angle degrees, wherein a positive valve overlap (PVO) refers to a period wherein both the exhaust valve 18 and the intake valve 20 are open and a negative valve overlap (NVO) refers to a period between closing of the exhaust valve 18 and subsequent opening of the intake valve 20 wherein both the intake valve 20 and the exhaust valve 18 are closed. When operating in the HCCI combustion mode, the intake and exhaust valves may have a NVO as part of an exhaust recompression strategy. In a SI-homogeneous combustion mode the intake and exhaust valves may have a NVO, but more typically will have a PVO.

The engine 10 includes a fuel injection system, comprising a plurality of high-pressure fuel injectors 28 each adapted to directly inject a mass of fuel into one of the combustion chambers 16, in response to a signal (INJ_PW) from the control module 5. The fuel injectors 28 are supplied pressurized fuel from a fuel distribution system.

The engine 10 includes a spark-ignition system by which spark energy is provided to a spark plug 26 for igniting or assisting in igniting cylinder charges in each of the combustion chambers 16 in response to a signal (IGN) from the control module 5. The spark plug 26 may enhance the ignition process of the engine at certain conditions such as for the HCCI combustion mode (e.g., during cold engine conditions and near a low load operation limit).

The engine 10 is equipped with various sensing devices for monitoring engine operation, including monitoring crankshaft rotational position, i.e., crank angle and speed. Sensing devices include a crankshaft rotational speed sensor (crank sensor) 44, a combustion sensor 30 adapted to monitor combustion and an exhaust gas sensor 80 adapted to monitor exhaust gases, for example using an air/fuel ratio sensor. The combustion sensor 30 comprises a sensor device operative to monitor a state of a combustion parameter and is depicted as a cylinder pressure sensor operative to monitor in-cylinder combustion pressure. The outputs of the combustion sensor 30, the exhaust gas sensor 80 and the crank sensor 44 are monitored by the control module 5 which determines combustion phasing, i.e., timing of combustion pressure relative to the crank angle of the crankshaft 12 for each cylinder 15 for each combustion cycle. The combustion sensor 30 may also be monitored by the control module 5 to determine a mean effective pressure (IMEP) for each cylinder 15 for each combustion cycle. Preferably, the engine 10 and control module 5 are mechanized to monitor and determine states of IMEP for each of the engine cylinders 15 during each cylinder firing event. Alternatively, other sensing systems may be used to monitor states of other combustion parameters within the scope of the disclosure, e.g., ion-sense ignition systems, and non-intrusive cylinder pressure sensors.

The engine 10 is designed to operate un-throttled on gasoline or similar fuel blends in the controlled auto-ignition combustion mode over an extended area of engine speeds and loads. However, spark-ignition and throttle-controlled operation may be utilized under conditions not conducive to the controlled auto-ignition combustion mode and to obtain maximum engine power to meet an operator torque request with engine power defined by the engine speed and load. Widely available grades of gasoline and lower ethanol blends thereof are preferred fuels; however, alternative liquid and gaseous fuels such as higher ethanol blends (e.g. E80, E85), neat ethanol (E99), neat methanol (M100), natural gas, hydrogen, biogas, various reformates, syngases, and others may be used.

The control module 5 is an element of an overall vehicle control system, preferably comprising a distributed control module architecture operable to provide coordinated system control. The control module 5 is operable to synthesize pertinent information and inputs from the aforementioned sensing devices, and execute algorithms to control various actuators to achieve control of fuel economy, emissions, performance, drivability, and protection of hardware, as described hereinbelow.

Control module, module, control, controller, control unit, processor and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any controller executable instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators. Routines may be executed at regular intervals, for example each 3.125, 6.25, 12.5, 25 and 100 milliseconds during ongoing engine and vehicle operation.

Operation in HCCI mode can be limited to an operating range permitting auto-ignition. Low load operation of the engine capable of sustaining auto-ignition can be enhanced or expanded by method known in the art. In one example, using variable valve actuation with unconventional valve means, a high proportion of high temperature, residual combustion products from the previous combustion cycle is retained to provide the necessary condition for auto-ignition in a highly diluted mixture.

In another example, low load operation of HCCI combustion can be enhanced or expanded through use of multiple fuel injections in the combustion cycle. A method to utilize multiple fuel injections with low load HCCI combustion is disclosed in commonly assigned and co-pending U.S. application Ser. No. 12/369,086 which is incorporated herein by reference.

In a fuel reforming method, using split injections with a large negative valve overlap (NVO) wherein the exhaust valve closes before intake valve opens, part of the total required fuel per cycle can be injected during recompression period after the exhaust valve closes and before the intake valve opens where gas temperature and pressure are high. The injected fuel goes through partial oxidation or reforming reaction to produce extra heat that's needed for auto-ignition. However, with even lower engine load, reforming of a portion of the fuel during recompression may not be enough to trigger auto-ignition. In a spark-assisted HCCI or flame propagation method, at low load or near-idle operation, a main part of the fuel mass can be injected late in the main compression rather than during intake. A stratified portion of the fuel can ignited by a spark, and a resulting pressure wave from the ignition compresses the remaining portion of the fuel-air mixture further to reach auto-ignition.

A strong correlation between the fuel mass reformed and combustion stability, illustrated by a coefficient of variation of integrated mean effective pressure (COV of IMEP), and NOx emissions can be shown. Reforming higher amounts of fuel during recompression reduces NOx emissions and increases COV of IMEP (indicating lower combustion stability). In the inverse, burning more fuel in the flame propagation method increases NOx emissions and reduces COV of IMEP. A mixed mode can be operated in which advantages of a reforming method and advantages of a flame propagation method can be achieved. Operation in a mixed mode can include multiple injections enabling reforming and flame propagation can include injecting fuel quantities during recompression for reforming and late in the compression stroke for flame propagation, with the fuel quantities reduced to a minimum possible amount to fulfill the required enhancement of HCCI operation. In one exemplary method, each of these two injections is followed by a spark discharge. In addition to the fuel quantities injected for reforming and flame propagation, a remainder of the fuel that is needed to reach a desired engine work output is introduced in one or more injection pulses during the intake stroke or early in the compression stroke.

To achieve robust mixed mode combustion, precise metering of injected fuel is important. Too little fuel in an injection can fail to provide the conditions necessary for auto-ignition; too much fuel in an injection can increase NOx production or unstable combustion. A method to determine or learn nonlinear characteristics of a fuel injector is disclosed in commonly assigned and co-pending U.S. application Ser. No. 12/791,385 which is incorporated herein by reference.

A learning cycle provides characteristics of the fuel injector for current operating conditions. Changing operating conditions such as changing temperature and/or humidity can cause the behavior of the fuel injector to change and invalidate the characteristics determined in a previous learning cycle. According to one embodiment, a learning cycle can be initiated for a detected change in operating conditions, for example, initiating the learning cycle based upon a detected change in temperature or humidity of intake air. Temperature or humidity can be measured, for example, in the intake manifold or in the air duct leading to the intake manifold. In another embodiment, a learning cycle can be initiated every time the engine begins operating in the mixed mode. In another embodiment, a learning cycle can be initiated if the vehicle remains in the mixed mode for more than a threshold time. In another embodiment, operating characteristics for a number of different operating conditions can be saved and indexed according to controlling variables such as temperature and humidity. A number of different methods to initiate learning cycles and utilize the characteristics determined are envisioned, and the disclosure is not intended to be limited to the particular examples provided.

For a given fuel rail pressure and other variables such as temperature and humidity, the fuel pulse width (FPW) can be expressed as a function of the fuel mass (fm) as follows:

$$\mathrm{FPW}=a_0+a_1\times fm+a_2\times fm^2+\ .\ .\ .\ +a_m\times fm^m \quad [1]$$

wherein m>0, and $a_0, a_1, \ldots a_m$ are constants.

It is seen that over the fuel range of mixed mode combustion, the fuel mass injected from the injector and the fuel pulse width can be approximately correlated with a slope and an offset yielding the following expression:

$$\mathrm{FPW}\approx y_o=a_0+a_1\times fm=\phi^T\theta_0 \quad [2]$$

wherein $y_o$=FPW, $\phi^T$=[1, fm], where $\phi$ represents a regression factor, and in one embodiment can represent a fuel mass injected into the cylinder, $\theta_o=[a_0, a_1]^T$, where $\theta$ represents estimated parameters of the RLS approximation illustrating behavior of the fuel injector.

As a result, only two parameters need to be estimated in the example, but the number of parameters is not intended to be limited. A real-time RLS approximation is used to estimate these parameters as follows.

$$P(k)=\frac{1}{\lambda}\left[P(k-1)-\frac{P(k-1)\varphi(k)\varphi^T(k)P(k-1)}{\lambda+\varphi^T(k)P(k-1)\varphi(k)}\right] \quad [3]$$

$$\hat{\theta}_0(k)=\hat{\theta}_0(k-1)+P(k)\varphi(k)\{y_0(k)-\varphi^T(k)\hat{\theta}_0(k-1)\} \quad [4]$$

wherein $\hat{\theta}_o$ is the estimated $\theta_o$, $\lambda$ is a forgetting factor, and P is the covariance matrix.

The convergence of parameter estimation depends on persistency of excitation (PE) of the regression vector $\phi(k)$. The PE of parameter estimation is poor if the engine is operated in steady state conditions since data collected for learning does not sufficiently cover the operating range of mixed-mode combustion. For rich PE, therefore, the engine should be operated at various fueling rates. In a real driving situation, however, normal operation of a vehicle cannot guarantee that the engine will be operated in a wide range of fueling rates providing a rich PE. Therefore, PE should be monitored in real-time and the estimated parameters from the learning cycle should be delivered after confirming rich PE.

Examination of PE is one method to confirm that engine operation has varied sufficiently such that the learning algorithm has enough data to complete the learning cycle. However, a number of statistical methods to examine engine operation can be utilized to similarly complete the learning cycle. In one embodiment, a method can compare a variance or minimum and maximum value of engine load or engine speed to a threshold variance, and if the variance indicates a wide range of engine operation, the learning cycle can be determined to be complete.

One way to confirm the PE condition is to check the condition number of the covariance matrix P(k). However, this method requires complex and intensive computations and may not be suitable for real-time implementation. Instead, PE and the convergence of the parameter can be examined indirectly.

According to one embodiment to indirectly examine PE and the convergence of the estimated parameter, a first step is to introduce a set of n regression models with n parameter vectors of known values, where n is the number of parameters in a parameter vector, as follows:

$$y_i(k)=\phi^T(k)\theta_i,\ (i=1, 2, \ldots, n) \quad [5]$$

wherein the regression vector $\phi^T(k)$ is the same as that of the RLS approximation.

The same RLS approximation can be applied to estimate parameters $\theta_i$, with initial estimations $\hat{\theta}_i(0)$. Since the same $\phi(k)$ of the original estimation determination is used, P(k) is obtained from the RLS approximation. The batch form of the RLS approximation is expressed as follows.

$$\begin{aligned}\hat{\theta}_i(k)-\hat{\theta}_i(0)&=P(k)\left(\sum_{l=0}^{k}\lambda^l\varphi(k-l)\{y_i(k-l)-\varphi^T(k-l)\hat{\theta}_i(0)\}\right)\\&=P(k)\left(\sum_{l=0}^{k}\lambda^l\varphi(k-l)\varphi^T(k-l)\right)\{\theta_i-\hat{\theta}_i(0)\}\end{aligned} \quad [6]$$

A pseudo-model or model parameter matrix, $\Theta$, can be defined to model behavior of the injector based upon $\theta$. If $\Theta$ converges, then it can be determined that the operation of the system includes sufficient variance or rich persistent excitation to complete the learning cycle. The following matrices can be defined.

$$\Theta=[\theta_1\ \theta_2\ldots\theta_n] \quad [7]$$

$$\hat{\Theta}(k)=[\hat{\theta}_1(k)\ \hat{\theta}_2(k)\ldots\hat{\theta}_n(k)] \quad [8]$$

$$\hat{\Theta}(0)=[\hat{\theta}_1(0)\ \hat{\theta}_2(0)\ldots\hat{\theta}_n(0)] \quad [9]$$

The model parameters $\theta_i$ and their initial estimates $\hat{\theta}_i(0)$ are chosen in accordance with the following relationship.

$$\mathrm{rank}([(\Theta-\hat{\Theta}(0))])=n\ [10]$$

Combining equations for all n models yields the following relationship.

$$[\hat{\Theta}(k)-\hat{\Theta}(0)]=P(k)(\Sigma_{l=0}^{k}\lambda^l\phi(k-l)\phi^T(k-l)[\Theta-\hat{\Theta}(0)] \quad [11]$$

Or, equivalently, the following relationship.

$$\hat{\Theta}(k)=\hat{\Theta}(k-1)+P(k)\phi(k)\phi^T(k)[\Theta-\hat{\Theta}(k-1)] \quad [12]$$

Since $[\Theta-\hat{\Theta}(0)]$ has full rank, equation 11 can be re-written as follows.

$$[\Theta-\hat{\Theta}(k)][\Theta-\hat{\Theta}(0)]^{-1}=[I-P(k)(\Sigma_{l=0}^{k}\lambda^l\phi(k-l)\phi^T(k-l))] \quad [13]$$

Similarly, by replacing $y_0(k-l)$ with $\phi_T(k-l)\theta_0(k)$, the RLS approximation can be written as the following relationship.

$$\hat{\theta}_0(k)-\hat{\theta}_0(0)=P(k)(\Sigma_{l=0}^{k}\lambda^l\phi(k-l)\phi^T(k-l))\{\theta_0-\hat{\theta}_0(0)\} \quad [14]$$

Or, equivalently, the following relationship.

$$\begin{aligned}\{\theta_0-\hat{\theta}_0(k)\}&=\left[I-P(k)\left(\sum_{l=0}^{k}\lambda^l\varphi(k-l)\varphi^T(k-l)\right)\right]\{\theta_0-\hat{\theta}_0(0)\}\\&=[\Theta-\hat{\Theta}(k)][\Theta-\hat{\Theta}(0)]^{-1}\{\theta_0-\hat{\theta}_0(0)\}\end{aligned} \quad [15]$$

Since the choice of $[\Theta-\hat{\Theta}(0)]$ is arbitrary as long as the matrix has a full rank, one can simply choose $\Theta=0$ and $\hat{\Theta}(0)=-I$. This further simplifies the determination to the following relationship.

$$\hat{\Theta}(k)=\hat{\Theta}(k-1)-P(k)\phi(k)\phi^T(k)\hat{\Theta}(k-1),\ \hat{\Theta}(0)=-I \quad [16]$$

If the following expression is true, $$\|[\Theta-\hat{\Theta}(k)]\|_F\leq\epsilon \quad [17]$$

wherein $\|A\|_F=\sqrt{\Sigma_{ij}a_{ij}^2}$ is a Frobenius norm of a matrix, and $\epsilon$ is an arbitrary constant >0, then the following inequality holds, $$\|\theta_0-\hat{\theta}_0(k)\|_2\leq\|\{\Theta-\hat{\Theta}(k)\}\|_F\|\theta_0-\hat{\theta}_0(0)\|_2\leq\epsilon\|\theta_0-\hat{\theta}_0(0)\|_2 \quad [18]$$

wherein $\|\cdot\|_2$ is 2-norm of a vector. Or equivalently, $$\text{if } \|[\hat{\Theta}(k)]\|_F\leq\epsilon, \text{ then } \|\theta_0-\hat{\theta}_0(k)\|_2\leq\epsilon\|\theta_0-\hat{\theta}_0(0)\|_2 \quad [19]$$

Based upon this relationship, an estimation ready flag test can be utilized as follows.

$$\text{If } \Sigma_{ij}\hat{\theta}_{ij}^2(k)<\epsilon^2, \text{ then flag=ON} \quad [20]$$

In this way, a flag can be utilized to determine when the learning cycle for the RLS approximation of the estimated parameters is complete. Based upon the flag signal being on, the determined estimated parameters can be used to control fuel injections based upon the modeled behavior of the fuel injector.

Figure 2:
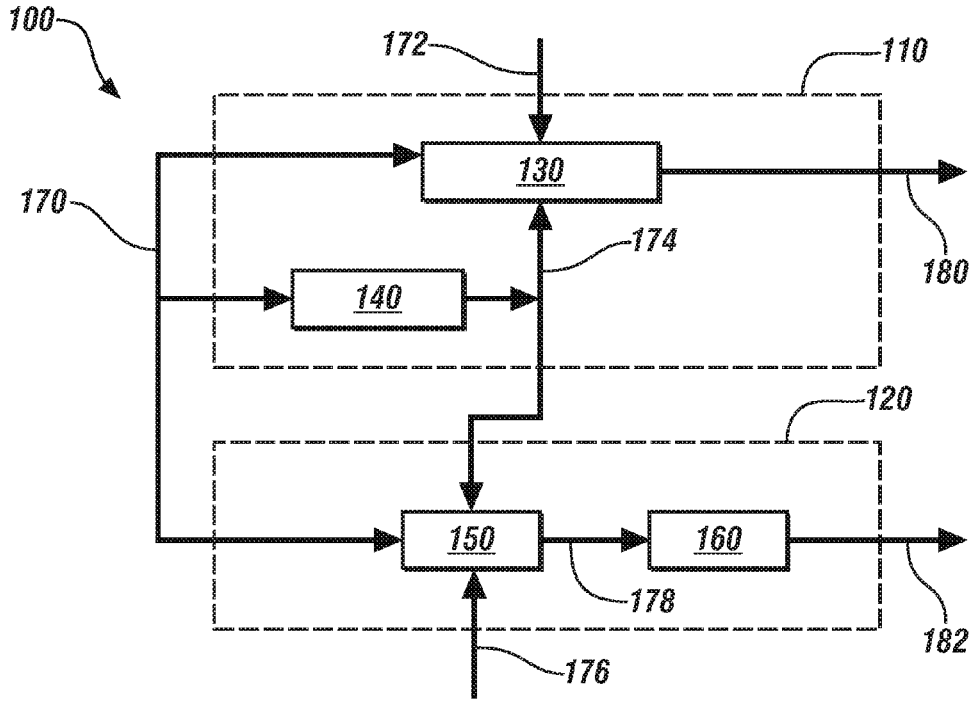
FIG. 2 illustrates an exemplary information flow to implement an recursive least squares determination and examine persistent excitation to determine an end to a learning cycle, in accordance with the present disclosure.

FIG. 2 illustrates an exemplary information flow to implement an RLS approximation and examine PE to determine an end to a learning cycle. Information flow 100 includes an RLS approximation module 110 and a PE test module 120. RLS approximation module 110 includes parameter estimation module 130 and covariance matrix module 140. Covariance matrix module 140 monitors an estimated fuel mass injected into the cylinder, $\phi(k)$ 170, and determines covariance matrix, P(k) 174. Covariance matrix module 140 can utilize Eq. 3 to determine P(k) 174. Parameter estimation module 130 monitors $\phi(k)$ 170, P(k) 174, and a current FPW, $y_0(k)$ 172, and determines estimated parameters of the RLS approximation of the fuel injector, $\hat{\theta}_0(k)$ 180. Parameter estimation module 130 can utilize Eq. 4 to determine $\hat{\theta}_0(k)$ 180. PE test module 120 includes model parameter matrix module 150 and estimation ready flag module 160. Model parameter matrix module 150 monitors $\phi(k)$ 170, P(k) 174, and initial estimate matrix, $\hat{\Theta}(0)$ 176, and determines model parameter matrix, $\hat{\Theta}(k)$ 178. Model parameter matrix module 150 can utilize Eq. 16, which includes an assumption that $\hat{\Theta}(0)$ 176 equals I. Estimation flag ready module 160 monitors $\hat{\Theta}(k)$ 178, determines whether the learning cycle is complete, and outputs ready flag signal 182. Estimation flag ready module 160 can utilize Eq. 20 to make the necessary determination for signal 182. Once the estimation ready flag has been raised, it can be safely assumed that the estimated parameter $\hat{\theta}_0(k)$ has been converged to the parameter $\theta_0$.

Figure 3:
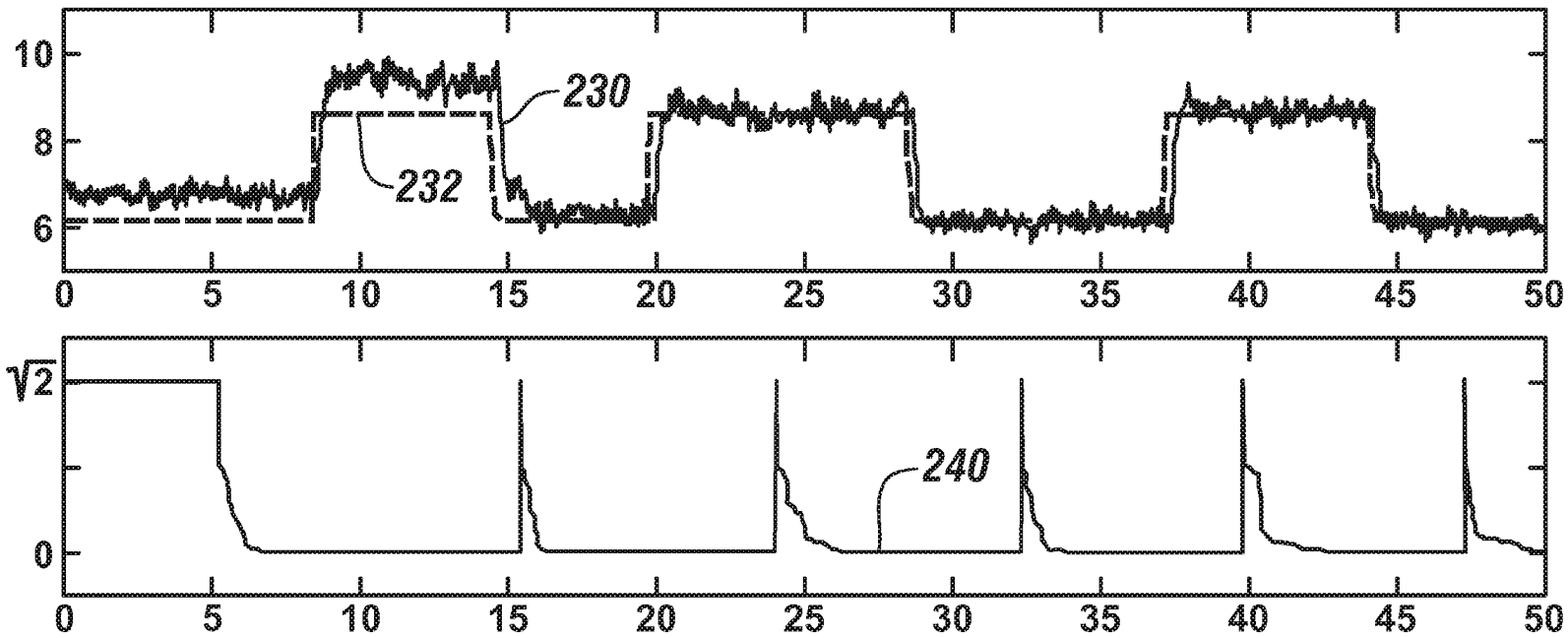
FIG. 3 graphically illustrates operation of a cylinder and a series of learning cycles analyzing the fuel injector for the cylinder, in accordance with the present disclosure.

FIG. 3 graphically illustrates operation of a cylinder and a series of learning cycles analyzing the fuel injector for the cylinder. Desired fuel and air fuel ratio are used to control the engine in mixed mode HCCI operation, and experimental data illustrates resulting fuel injection. The experiment begins with a default fuel injector control method, and, as the experiment progresses, iterations of learning cycles improve control of the fuel injection such that the experimental data converges with the desired values. An RLS approximation is in operation including a PE test activating a ready flag. Two portions to the graph are illustrated with a common horizontal axis time frame in seconds. A top portion of the graph illustrates a fuel mass injected into the cylinder per combustion cycle in milligrams estimated based on air flow and air fuel ratio. Plot 230 illustrates estimated fuel mass injected, and plot 232 illustrates desired fuel mass injected. Plot 230 illustrates fuel changing several times through the illustrated time span. A bottom portion of the graph illustrates a Frobenius norm of a model parameter matrix, $\|[\hat{\Theta}(k)]\|_F$. Plot 240 illustrates operation of the pseudo-model determining $\hat{\Theta}$ corresponding to operation of the disclosed methods to determine operation of the fuel injector. Values of plot 240 of approximately square root of two indicate that the determination is either not operative or has been reset. Plot 240 illustrates that for the first five seconds of the experiment, the pseudo-model is not operative. At about five seconds, the operation of the pseudo-model is initiated. At approximately eight seconds, the mass air flow and fuel mass injected are changed, resulting in a change in operation of the engine, and a second change in engine operation occurs at approximately fifteen seconds. At just after fifteen seconds, a determination is made that the changing operation of engine satisfies the persistent excitation requirement to complete the learning cycle. In this particular experiment, the pseudo-model is then reset and the method begins a new learning cycle. In other embodiments, the method can be suspended with the results of the first approximation available for use in controlling fuel injection. The pseudo-model continues to operate and periodically reset as the engine continues to change operation providing a rich PE through the illustrated time span. Given an $\epsilon$ value, the figure shows that the PE testing method promptly determines if learning is completed. Once learning is completed, the method delivers the estimated parameters to the fuel controller and is initialized to repeat learning. It is shown that after the first learning, estimated fuel injected in the cylinder closely follows the desired fuel.

Figure 4:
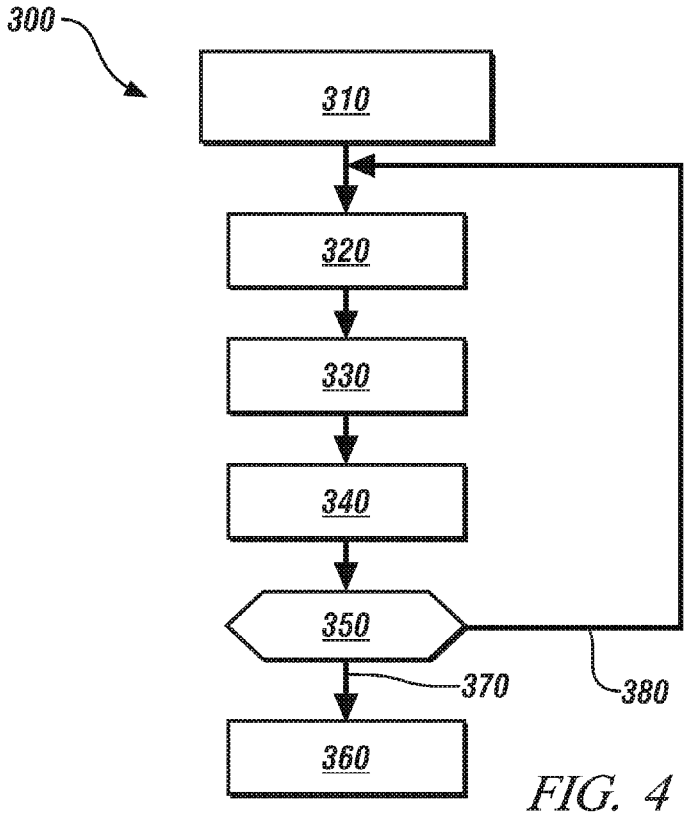
FIG. 4 illustrates a process to operate a learning cycle and determine that a learning cycle is complete, in accordance with the present disclosure.

FIG. 4 illustrates a process to operate a learning cycle and determine that a learning cycle is complete. Table 1 is provided as a key to FIG. 4 wherein the numerically labeled blocks and the corresponding functions are set forth as follows.

TABLE 1

| BLOCK | BLOCK CONTENTS |
|---|---|
| 310 | Initiate Learning Cycle |
| 320 | Monitor Operation of the Engine |
| 330 | Approximate Behavior of the Fuel Injector |
| 340 | Evaluate Persistent Excitation |
| 350 | Is the Learning Cycle Complete Based Upon Rich Persistent Excitation? |
| 360 | End |

Process 300 begins at block 310 whereat a learning cycle is initiated. At block 320, operation of the engine is monitored. In one embodiment, monitoring operation of the engine can include monitoring an estimated fuel mass injected into the cylinder and monitoring a current fuel pulse width. At block 330, behavior of the fuel injector is approximated based upon methods disclosed herein. At block 340, persistent excitation of the operation of the engine is evaluated. At block 350, a determination is made whether the persistent excitation has been sufficiently rich to complete the learning cycle. If the persistent excitation has been sufficiently rich, then the process follows path 370 and ends at block 360. If the persistent excitation has not been sufficiently rich, then the process returns by path 380 to block 320 to continue the learning cycle. Process 300 is an exemplary process to employ the methods disclosed herein. A number of exemplary processes are envisioned, and the disclosure is not intended to be limited to the example provided.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method to control an internal combustion engine comprising a fuel injector and a corresponding cylinder and operable in a homogenous charge compression ignition combustion mode, the method comprising:

operating the engine in the homogenous charge compression ignition combustion mode comprising mixed mode operation;

operating a learning cycle to approximate characteristics of the fuel injector, comprising:

monitoring operation of the engine;

approximating the characteristics of the fuel injector by utilizing a recursive least squares approximation based upon the monitored operation;

evaluating persistent excitation of the engine based upon the monitored operation; and completing the learning cycle based upon the persistent excitation indicating a predetermined rich excitation indicating that the operation of the engine has varied enough to complete the learning cycle; and once the learning cycle is complete, operating the engine based upon said approximated characteristics of the fuel injector.

2. The method of claim 1, wherein monitoring operation of the engine comprises:

monitoring an estimated fuel mass injected into the cylinder; and monitoring a current fuel pulse width.

3. The method of claim 1, wherein utilizing the recursive least squares approximation comprises:

determining a covariance matrix based upon an estimated fuel mass injected into the cylinder; and determining estimated parameters of the fuel injector based upon the estimated fuel mass injected into the cylinder, the covariance matrix, and a current fuel pulse width.

4. The method of claim 3, wherein evaluating persistent excitation of the engine comprises:

determining a model parameter matrix based upon the estimated fuel mass injected into the cylinder, the covariance matrix, and an initial estimate matrix; and evaluating the persistent excitation based upon the model parameter matrix.

5. The method of claim 4, wherein evaluating persistent excitation of the engine further comprises determining the model parameter matrix to converge.

6. The method of claim 1, wherein operating the learning cycle is initiated based upon the engine entering the mixed mode operation.

7. The method of claim 1, wherein operating the learning cycle is initiated based upon the engine remaining in the mixed mode operation for more than a threshold time.

8. The method of claim 1, wherein operating the learning cycle is initiated based upon a monitored change in intake air temperature.

9. The method of claim 1, wherein operating the learning cycle is initiated based upon a monitored change in intake air humidity.

10. System to control an internal combustion engine, comprising:

a fuel injector; and a control module operating a learning cycle to approximate characteristics of the fuel injector, comprising monitoring operation of the engine, approximating the characteristics of the fuel injector with a recursive least squares approximation based upon the monitored operation, evaluating persistent excitation of the engine based upon the monitored operation, and completing the learning cycle based upon the persistent excitation indicating a predetermined rich excitation indicative that the operation of the engine has varied enough to complete the learning cycle; and once the learning cycle is complete, operating the engine based upon said approximated characteristics of the fuel injector.

11. The system of claim 10, wherein the control module further commands operation of the engine in a homogenous charge compression ignition combustion mode comprising mixed mode operation.

* * * * *